US008083647B2

(12) United States Patent
Park

(10) Patent No.: US 8,083,647 B2
(45) Date of Patent: Dec. 27, 2011

(54) TREADMILL SYSTEM AND OPERATING METHOD OF THE SAME

(75) Inventor: Woo Jin Park, Seoul (KR)

(73) Assignee: Elancer Inc., Bangbae-Dong, Seocho-Gu, Seoul (KR)

( * ) Notice: Subject to any disclaimer, the term of this patent is extended or adjusted under 35 U.S.C. 154(b) by 74 days.

(21) Appl. No.: 12/778,105

(22) Filed: May 11, 2010

(65) Prior Publication Data

US 2011/0177914 A1 Jul. 21, 2011

(30) Foreign Application Priority Data

Jun. 26, 2009 (KR) ..... 10-2009-0057688

(51) Int. Cl.
*A63B 71/00* (2006.01)

(52) U.S. Cl. ..... 482/8; 482/1; 482/9; 482/54; 482/901

(58) Field of Classification Search ..... 482/1–9, 482/51, 54, 900–902; 119/700
See application file for complete search history.

(56) References Cited

U.S. PATENT DOCUMENTS 6,244,987 B1 * 6/2001 Ohsuga et al. ..... 482/4
7,693,584 B2 * 4/2010 Pryor et al. ..... 700/17
7,791,808 B2 * 9/2010 French et al. ..... 359/630

* cited by examiner

*Primary Examiner* — Glenn Richman
(74) *Attorney, Agent, or Firm* — Lexyoume IP Group, PLLC.

(57) ABSTRACT

Provided is a treadmill-related technology. That is, the treadmill device and the operating method of the same is configured to detect a user who is taking exercise in real time, take pictures of the detected user's looks, and insert user image data as the results of data analysis, which are obtained from the taken pictures, into a virtual 3D object moving image which indicates the selected exercise course background, so as to project a 3D user image in which the user's behavior patterns are engaged with a virtual 3D object moving image. Therefore, since the treadmill device is used to allow a user to see his own looks taking exercise in real time, it is possible to prevent the user from feeling boring during exercise, and it is easy to continuously check the user's own physical status or conditions. Also, since a user may actively employ exercise course backgrounds which are freely changed during exercise by the user's choices, the best information on the physical rhythm and exercise conditions may be offered to the user, thereby improving the user's satisfaction and buying power, which leads to an expected increase in the sales.

10 Claims, 6 Drawing Sheets

TREADMILL SYSTEM AND OPERATING METHOD OF THE SAME

CROSS-REFERENCE TO RELATED APPLICATIONS

This application claims priority under 35 U.S.C. §119 to Korean Patent Application No. 2009-0057688, filed on Jun. 26, 2009, in the Korean Intellectual Property Office, the disclosure of which is incorporated herein by reference in its entirety.

TECHNICAL FIELD

The present invention relates to treadmill-related technologies, and more particularly to a treadmill system with display device and operating method of the same.

BACKGROUND

Treadmills refer to exercise machines called running machines, and are widely used for homes or sports centers since they have an exercise effect of walking or running on a rotating belt as an endless track in narrow spaces.

Treadmills are increasingly used from day to day since they may be used indoors at a suitable temperature even in winter for the walking or running exercises, and their running speed may be adjusted properly.

In general, a user uses a treadmill to do walking or running exercise. In this case, the user can do the walking or running exercise while adjusting the walking or running speed, depending on the user's tastes.

However, the conventional treadmills have problems in that it is difficult for a user to see his own looks taking exercise in real time, and thus to feel boring during exercise, which render it more difficult to check the user's own physical status or conditions.

Also, the conventional treadmills have problems in that users see things from a distance or look at minors or on dashboards in order to avoid feel boring during exercise, but these behaviors do not entirely aid in giving the motivation and enthusiasm for the exercise due to the spatial and time limits. That is, the conventional treadmills have problems in that it is impossible to expect the maximum effects on exercise which the users can satisfy since they do not satisfactorily support the users' physical rhythm managements and exercise circumstances.

SUMMARY

Accordingly, a treadmill device and operating method of the same according to the present invention are designed to solve the foregoing problems of the prior art, and therefore an embodiment of the present invention provides a treadmill device and an operating method of the same, which is able to detect an exercising user in real time, take images of the detected user's looks and insert the user image data which are obtained from data analysis of the taken images, into a virtual 3D object moving image which indicates the selected exercise course background, so as to project a 3D user image in which the user's behavior patterns are engaged with a virtual 3D object moving image. Therefore, since the treadmill device is used to allow a user to see his own exercising looks in real time, it is possible to prevent the user from being bored during exercise, and it is easy to continuously check the user's own physical status or conditions.

Also, an embodiment of the present invention provides a treadmill device and an operating method of the same, which is able to offer the best information on the physical rhythm and exercise conditions to the user since a user may actively employ exercise course backgrounds which are freely changed during exercise by the user's choices, thereby improving the user's satisfaction and purchasing desire, which leads to an expected increase in the sales.

Exemplary embodiments of the present invention may be configured as follows.

That is, the treadmill system according to one exemplary embodiment of the present invention, which includes a treadmill device performing a running action and an image photographing and controlling unit taking images of exercising user with the treadmill device , is characterized in that the treadmill device is configured to control a displaying operation so that it can allow a user to select one of a plurality of already stored exercise course backgrounds, display the selected exercise course background as a virtual 3D object moving image, and project the virtual 3D object moving image at a reproduction rate corresponding to an operating rate of the treadmill device; and the image photographing and controlling unit is configured to detect the user's looks in real time, take pictures of the detected user's actual looks to generate user image data, extract and filter noise image data from the user image data, and extract only the pure user image data remaining after the filtering operation, wherein the treadmill device receives the pure user image data from a local area network connected with the image photographing and controlling unit, inserts the pure user image data into the virtual 3D object moving image, finally generates a 3D user image in which the user's behavior patterns, which appear on the basis of the pure user image data, are engaged with the virtual 3D object moving image, and projects the 3D user image.

Also, the method of operating a treadmill device on a treadmill system according to one exemplary embodiment of the present invention, in which the treadmill device is configured to perform a running action and an image photographing and controlling unit is configured to take images of exercising user with the treadmill device, is characterized in that the operating method includes:

allowing a user to select one of a plurality of already stored exercise course backgrounds and displaying the selected exercise course background as a virtual 3D object moving image at the treadmill device; controlling a displaying operation at the treadmill device to display the virtual 3D object moving image at a reproduction rate corresponding to the operating rate of the treadmill device; detecting the user's looks in real time and taking pictures of the detected user's looks and generating user image data from the taken pictures at the image photographing and controlling unit; extracting and filtering only noise image data from the user image data and extracting only pure user image data remaining after the filtering operation at the image photographing and controlling unit; receiving the pure user image data from the local area network connected with the image photographing and controlling unit and inserting the pure user image data into the virtual 3D object moving image at the treadmill device; and finally generating a 3D user image in which the user's behavior patterns, which appear on the basis of the pure user image data, are engaged with the virtual 3D object moving image and projecting the 3D user image at the treadmill device.

Other features and aspects will be apparent from the following detailed description, the drawings, and the claims.

DETAILED DESCRIPTION OF EMBODIMENTS

The advantages, features and aspects of the present invention will become apparent from the following description of the embodiments with reference to the accompanying drawings, which is set forth hereinafter. The present invention may, however, be embodied in different forms and should not be construed as limited to the embodiments set forth herein. Rather, these embodiments are provided so that this disclosure will be thorough and complete, and will fully convey the scope of the present invention to those skilled in the art. The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments of the present invention will be described in detail with reference to the accompanying drawings.

EMBODIMENTS

Figure 1:
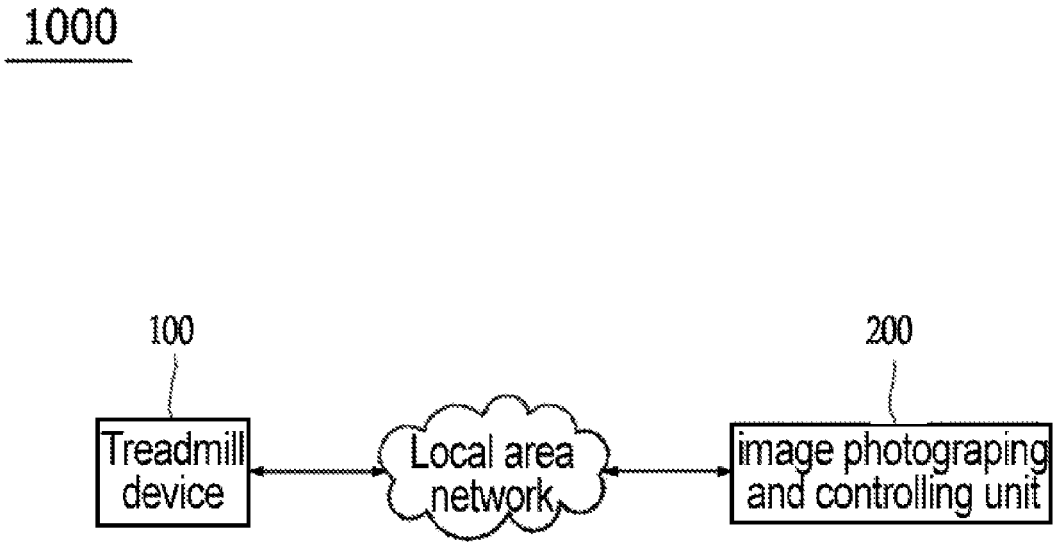
FIG. 1 is a block view illustrating a treadmill system according to one exemplary embodiment of the present invention.

FIG. 1 is a block view illustrating a treadmill system according to one exemplary embodiment of the present invention.

Referring to FIG. 1, the treadmill system 1000 according to one exemplary embodiment of the present invention includes a treadmill device 100 and an image photographing and controlling unit 200. Here, the treadmill device 100 is configured to detect the looks of a user who is walking on a walking belt and automatically adjust an operating rate of walking belt, and the image photographing and controlling unit 200 is configured to take pictures of the user's looks.

First of all, the treadmill device 100 is configured to control a displaying operation by allowing a user to select one of a plurality of already stored exercise course backgrounds, followed by operating the selected exercise course background to display a virtual 3D object moving image and projecting the virtual 3D object moving image at a reproduction rate corresponding to an operating rate of the treadmill device 100.

The treadmill device 100 is configured to insert the pure user image data into the virtual 3D object moving image, followed by finally generating a predetermined 3D user image in which the user's behavior patterns, which appear on the basis of the pure user image data, are engaged with the virtual 3D object moving image, and projects the 3D user image. Here, the pure user image data are transmitted from a local area network that is already connected with the image photographing and controlling unit 200 as described below.

Figure 4:
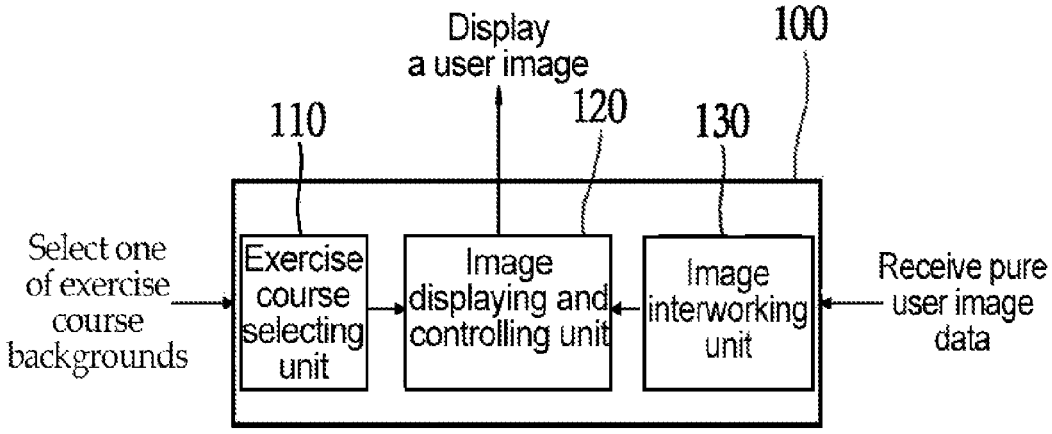
FIG. 4 is a block view illustrating a treadmill device used for the treadmill system according to one exemplary embodiment of the present invention.

The treadmill device 100 is configured as shown in FIG. 4, and its operations are described in detail, as follows.

That is, the treadmill device 100 includes an exercise course selecting unit 110, an image displaying and controlling unit 120 and an image interworking unit 130.

The exercise course selecting unit 110 allows a user to select one of a plurality of already stored exercise course backgrounds. In this case, the plurality of exercise course backgrounds are obtained by taking pictures of a promenade, a mountain path, a riverside path or a beach path in the 3D configuration and storing the pictures in a memory unit mounted in the treadmill device 100.

The image displaying and controlling unit 120 is configured to control a displaying operation by displaying the selected exercise course background as a virtual 3D object moving image and projecting the virtual 3D object moving image at a reproduction rate corresponding to the operating rate of the treadmill device 100.

That is, the image displaying and controlling unit 120 displays the exercise course background in the 3D configuration using an image display window mounted in the treadmill device 100, and the treadmill device 100 adjusts a reproduction rate of the virtual 3D object moving image, which is realized from the exercise course background, so that the reproduction rate can correspond to the operating rate of the treadmill device 100 on which a user is taking exercise.

The image interworking unit 130 is controlled in such manner that the user's behavior patterns are overlappingly engaged with the virtual 3D object moving image by inserting the pure user image data, which are transmitted from a local area network, onto the virtual 3D object moving image.

That is, the image interworking unit 130 receives noise data-free pure user image data from the user image data in which the image photographing and controlling unit 200 connected with the local area network is used to takes pictures of the user's exercise looks in the four directions (or, the six, eight or sixteen directions).

The image interworking unit 130 is controlled in such manner that the user's behavior patterns displayed in the form of 3D image are realized together on the virtual 3D object moving image by applying the pure user image data to the virtual 3D object moving image as the exercise course background.

In turn, the image photographing and controlling unit 200 detects the user's looks in real time, and takes pictures of the detected user's looks to generate user image data.

The image photographing and controlling unit 200 extracts and filters only noise image data from the user image data, and extracts only the pure user image data remaining after the filtering operation.

That is, the image photographing and controlling unit 200 is configured to detect the looks of a user who is taking exercise on the treadmill device 100 in real time and take pictures of the detected user's looks to generate user image data and extracts noise signal-free pure user image data from the user image data, followed by transmitting the pure user image data through the local area network connected with the treadmill device 100, or displaying the pure user image data using a display system (for example, a projector, a LED signboard, a flat panel display device) provided in the treadmill device 100.

Figure 5:
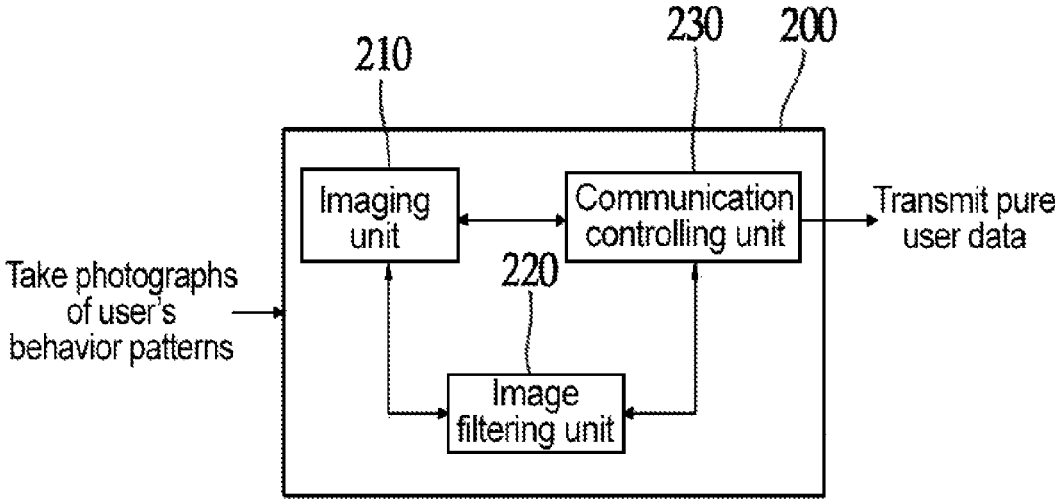
FIG. 5 is a block view illustrating an image photographing and controlling unit of the treadmill system according to one exemplary embodiment of the present invention.

The image photographing and controlling unit 200 is configured as shown in FIG. 5, and its operation is described in detail, as follows.

The image photographing and controlling unit 200 includes an imaging unit 210, an image filtering unit 220 and a communication controller 230, and further includes a projector 240.

The imaging unit 210 is configured to detect the user's looks in real time and take pictures of the detected user's looks to generate user image data.

The imaging unit 210 is generally a device that functions to take pictures of the looks of a user who is taking exercise on the treadmill device 100. In this case, the imaging unit 210 may include a camera mounted thereto for taking pictures of the user's looks. Then, the imaging unit 210 is used to generate predetermined user image data.

In this case, it is considered that the imaging unit 210 may be mounted in the image photographing and controlling unit 200, or be installed outside the image photographing and controlling unit 200.

The image filtering unit 220 receives the user image data, and then extracts and filters only noise image data from the user image data, and extracts only the pure user image data remaining after the filtering operation.

The image filtering unit 220 identifies images such as backgrounds, surrounding characters and surrounding objects, except for the noise image data, that is, the user image, that is present in the user image data, and filters only the noise image data from the user image data.

Also, the image filtering unit 200 extracts only the pure user image data which indicates the user image remaining after the filtering operation.

Figure 2:
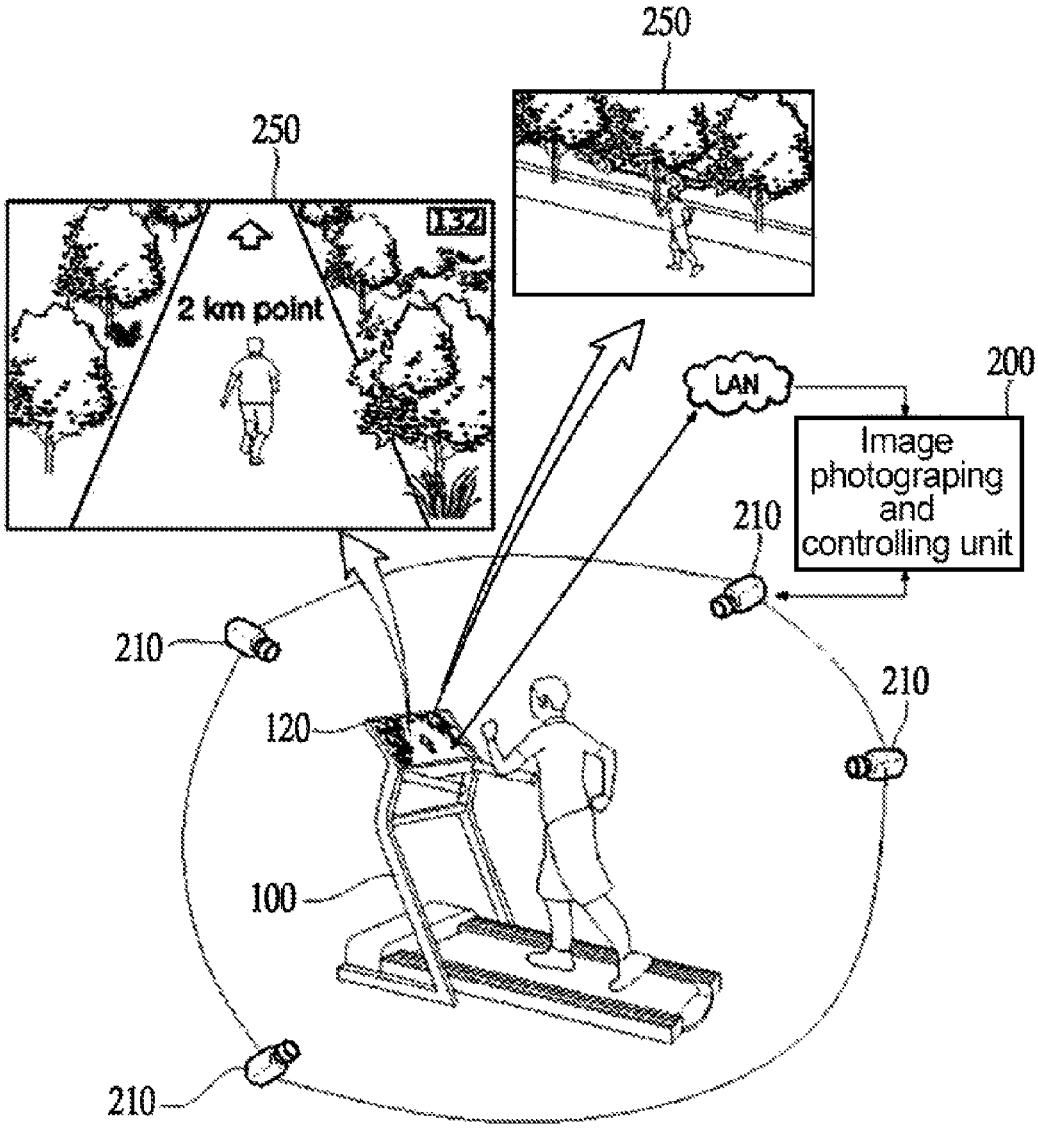
FIG. 2 is a diagram illustrating that a treadmill system according to one exemplary embodiment of the present invention is used to project a 3D user image.

As described in the one exemplary embodiment as shown in FIG. 2, the communication controller 230 transmits the pure user image data using the local area network connected with the treadmill device 100, and controls the imaging unit 210 and the image filtering unit 200 to process signals, respectively.

Therefore, the treadmill device 100 receives the pure user image data, which are transmitted by the communication controller 230 of the image photographing and controlling unit 200, through the local area network, and uses the image displaying and controlling unit 120 provided in the treadmill device 100 to finally generate a 3D user image 250 in which the user's behavior patterns, which appear on the basis of the pure user image data, are engaged with the virtual 3D object moving image, and to project the finally generated 3D user image.

Referring again to FIG. 2, since the treadmill device 100 and the image photographing and controlling unit 200 are connected with each other through the local area network, the image photographing and controlling unit 200 uses the imaging unit 210, the image filtering unit 220 and the communication controller 230 provided therein to filter the user image data that are generated by taking pictures of the user's actual looks who is taking exercise on the treadmill device 100, and to transmit to the treadmill device 100 the pure user image data extracted therethrough.

The treadmill device 100 receives the pure user image data transmitted from the image photographing and controlling unit 200, and uses the exercise course selecting unit 110, the image displaying and controlling unit 120 and the image interworking unit 130 provided therein to insert the pure user image data into the virtual 3D object moving image referred to as the selected exercise course background, thereby projecting the 3D user image 250 so that an operating rate of the user who is taking exercise can correspond to a reproduction rate of the virtual 3D object moving image.

Figure 3:
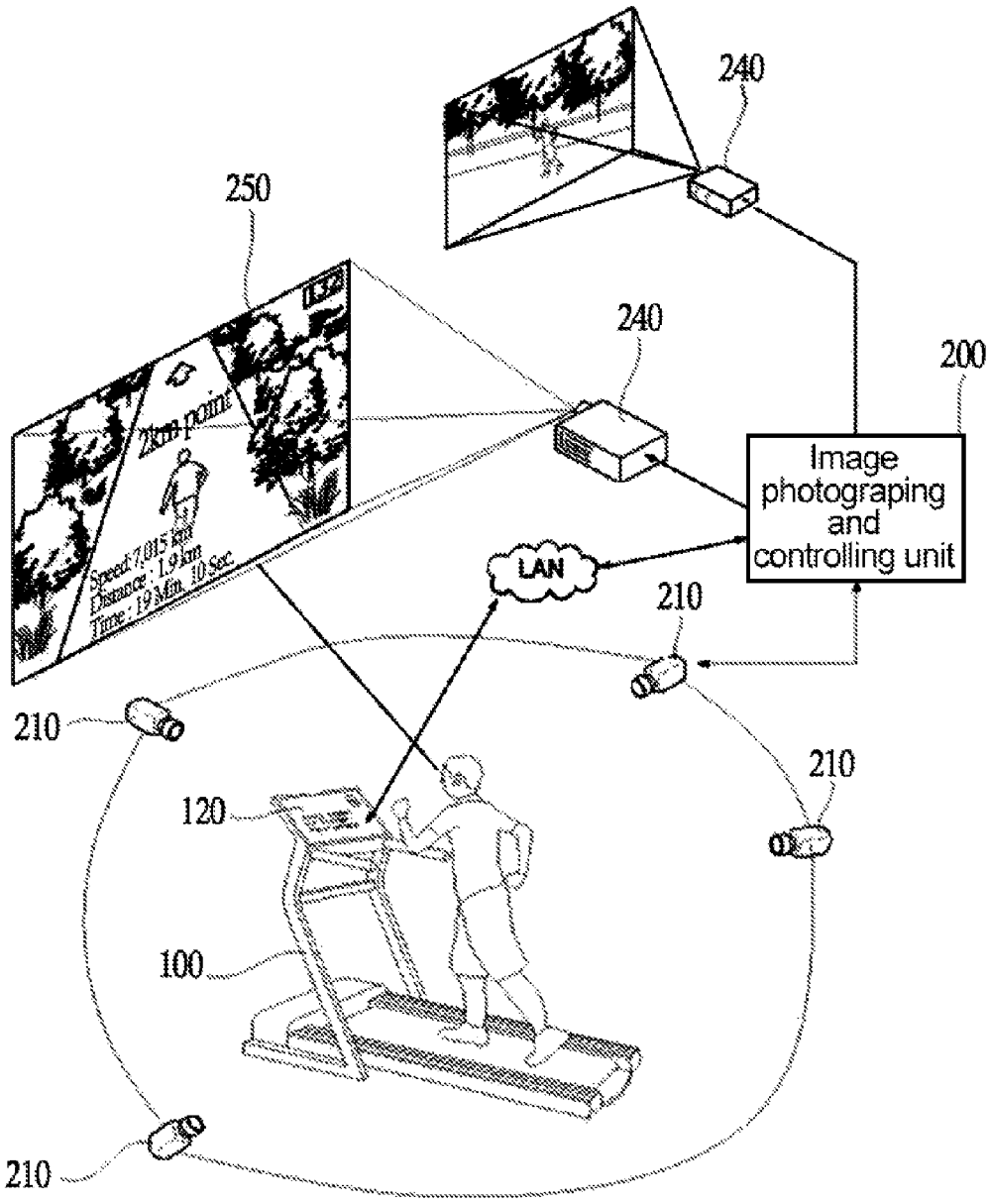
FIG. 3 is a diagram illustrating that a 3D user image is projected on a screen installed in a treadmill system according to one exemplary embodiment of the present invention.

As described in the another exemplary embodiment as shown in FIG. 3, the projector 240 uses a lens installed therein to shape the user image data generated by the imaging unit 210, followed by projecting the user image data with enlarged magnifications and displaying the user image data on a screen.

That is, the image photographing and controlling unit 200 uses the image filtering unit 220 to generate pure user image data from the pictures of the user's looks taken by the imaging unit 210, and inserts the pure user image data into the selected exercise course background under control of the communication controller 230, the selected exercise course background being transmitted from the local area network.

The image photographing and controlling unit 200 projects a 3D user image as the final image on a screen installed in the treadmill system by engaging the user's behavior patterns, which appear on the basis of the pure user image data, with the virtual 3D object moving image in which the exercise course background is operated.

Another exemplary embodiment of the present invention will be described in detail, as follows.

When the image photographing and controlling unit 200 has a plurality of imaging units 210 installed therein as shown in FIG. 2, the plurality of imaging units 210 generate a plurality of user image data by detecting the user's looks in many directions and taking as many pictures of the detected user's looks as the number of the imaging units 210.

The image filtering unit 220 receives a plurality of user image data, and then extracts only a plurality of pure user image data by filtering all of the noise image data that are present in each of the plurality of user image data.

As the communication controller 230 transmits the plurality of extracted pure image data to the treadmill device 100 through the local area network connected with the treadmill device 100, the treadmill device 100 is controlled in such manner that the user's behavior patterns are shaped on the virtual 3D object moving image into a 3D configuration, by inserting the plurality of pure image data onto the virtual 3D object moving image.

Referring again to FIG. 3, since the image photographing and controlling unit 200 uses the imaging unit 210, the image filtering unit 220 and the communication controller 230 provided therein, and is connected with the treadmill device 100 through the local area network, the image photographing and controlling unit 200 filters the user image data generated by taking pictures of the looks of a user who is taking exercise on the treadmill device 100, and then applies the filtered pure user image data onto the selected exercise course background transmitted from the local area network.

That is, the image photographing and controlling unit 200 is controlled to use a projector 240 provided therein to project the 3D user image 250 as the final image on a screen as the user's behavior patterns, which appear on the basis of the pure user image data, are engaged with the virtual 3D object moving image which indicates the selected exercise course background.

Also, as the image photographing and controlling unit 200 receives the operating rate of the user who is taking exercise on the treadmill device 100 through the local area network, it controls a displaying operation to display the virtual 3D object moving image, so that the operating rate of the user can correspond to the reproduction rate of the virtual 3D object moving image as the selected exercise course background.

Figure 6:
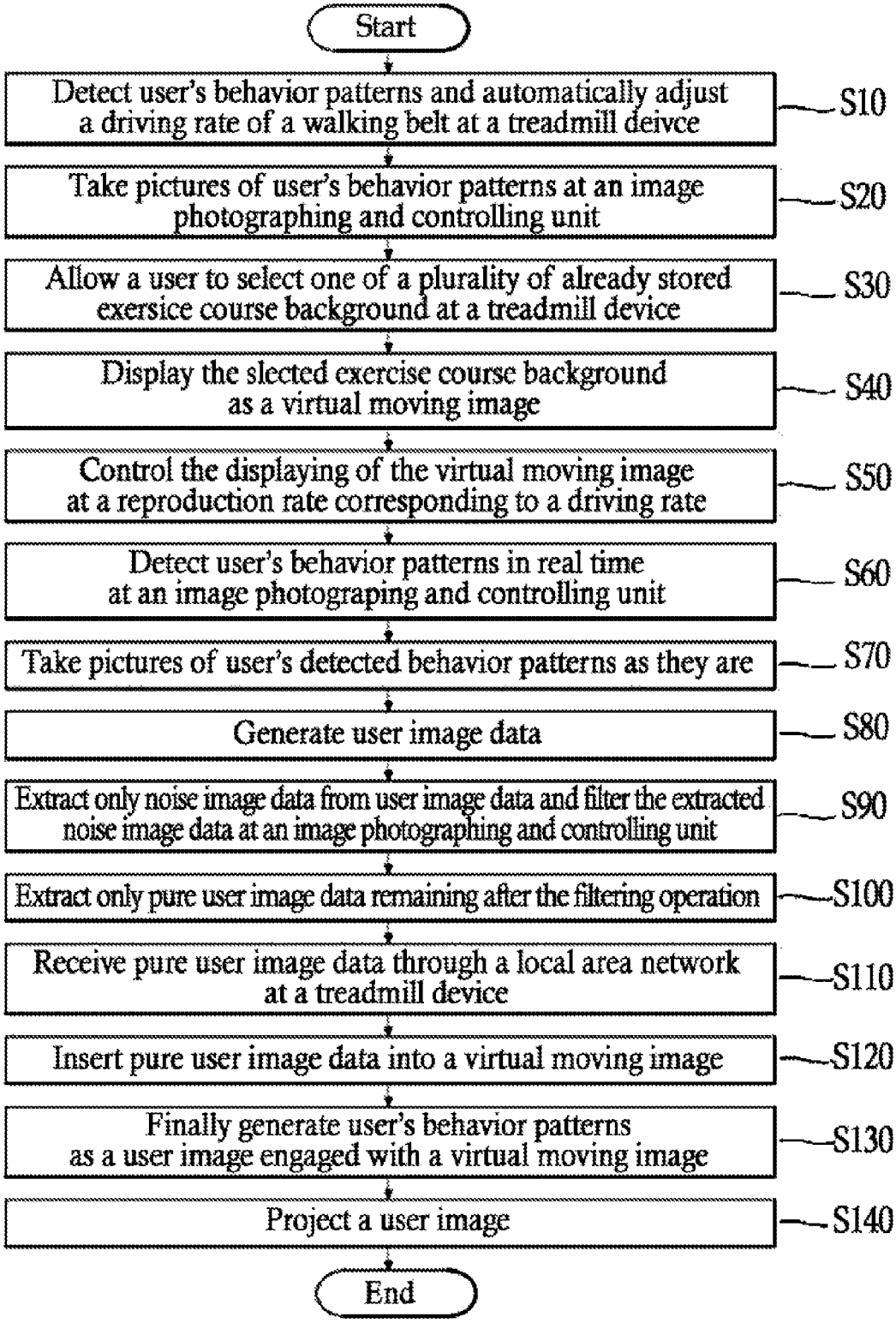
FIG. 6 is a flow chart illustrating a method of operating a treadmill device on a treadmill system according to one exemplary embodiment of the present invention.

FIG. 6 is a flow chart illustrating a method of operating a treadmill device on a treadmill system according to one exemplary embodiment of the present invention.

Referring to FIG. 6, the method of operating a treadmill device on a treadmill system is an operating method for finally projecting a 3D user image. In this case, the treadmill device detects the looks of a user who is walking on a walking belt to automatically adjust an operating rate of walking belt (S10), and the image photographing and controlling unit takes pictures of the looks of the user who is taking exercise (S20).

That is, the treadmill device allows a user to select one of a plurality of already stored exercise course backgrounds, and displays the selected exercise course background as a virtual 3D object moving image (S30 and S40).

The treadmill device controls a displaying operation to project the virtual 3D object moving image at a reproduction rate corresponding to the operating rate of the user (S50).

The image photographing and controlling unit detects the looks of a user who is taking exercise on the treadmill device 100 in real time, takes pictures of the detected user's actual looks, and generates user image data from the taken pictures of the user's looks (S60, S70 and S80).

The image photographing and controlling unit extracts and filters only the noise image data from the user image data, and extracts only the pure user image data remaining after the filtering operation (S90 and S100).

The treadmill device receives the pure user image data from the local area network connected with the image photographing and controlling unit, and inserts the received pure user image data onto the virtual 3D object moving image (S110 and S120).

The treadmill device finally generates a 3D user image in which the user's behavior patterns, which appear on the basis of the pure user image data, are engaged with the virtual 3D object moving image, and then projects the 3D user image (S130 and S140).

Hereinafter, the operation of the treadmill system will be described in more detail, as follows. That is, the treadmill device uses the exercise course selecting unit, the image displaying and the controlling unit and image interworking unit provided therein to perform the following detailed operation of the treadmill system, and the image photographing and controlling unit is operated through the imaging unit, the image filtering unit and the communication controller, depending on the following detailed operation of the treadmill system.

That is, the exercise course selecting unit provided in the treadmill device allows a user to select one of a plurality of already stored exercise course backgrounds.

The image displaying and controlling unit displays the selected exercise course background as a virtual 3D object moving image, and controls a displaying operation to project the virtual 3D object moving image at a reproduction rate corresponding to the operating rate of the treadmill device.

The image interworking unit is controlled in such manner that the user's behavior patterns are engaged with the virtual 3D object moving image by inserting the pure user image data, which are transmitted from the local area network, onto the virtual 3D object moving image.

The image displaying and controlling unit overlaps the user's behavior patterns with the virtual 3D object moving image, so that the user's behavior patterns can be engaged with the virtual 3D object moving image.

Also, the imaging unit provided in the image photographing and controlling unit detects the user's looks, and takes pictures of the detected user's looks to generate user image data.

The image filtering unit receives the user image data, and then extracts and filters only the noise image data from the user image data, and extracts only the pure user image data remaining after the filtering operation.

The communication controller transmits the pure user image data using the local area network connected with the treadmill device, and controls the imaging unit and the image filtering unit to process signals, respectively.

In addition, the projector further provided in the image photographing and controlling unit receives the user image data, and uses a lens installed therein to project the user image data with an enlarged magnification and displaying the user image data on a screen.

For the description of another operation of the treadmill system, when the imaging units are, for example, present in the plural number, the plurality of imaging units generate a plurality of user image data by detecting user's looks in many directions and taking pictures of the detected user's looks in many directions.

The image filtering unit extracts only a plurality of pure user image data by filtering all of the noise image data that are present in each of the plurality of user image data.

As the communication controller transmits the plurality of extracted pure image data to the treadmill device through the local area network connected with the treadmill device, the treadmill device is controlled in such manner that the user's behavior patterns, which are shaped into a 3D configuration, are engaged with the virtual 3D object moving image after the operation of inserting the plurality of pure image data onto the virtual 3D object moving image.

Figure 7:
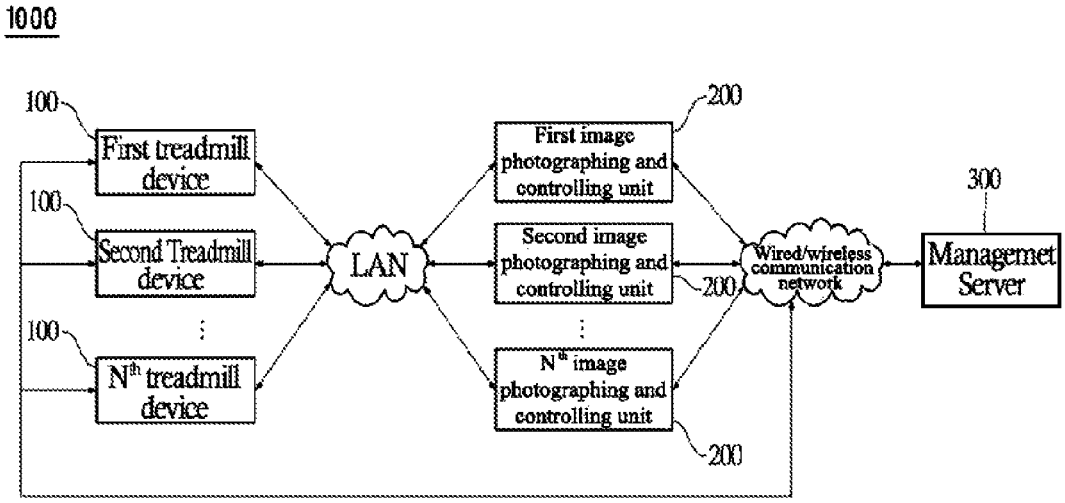
FIG. 7 is a block view illustrating a treadmill system according to another exemplary embodiment of the present invention.

FIG. 7 is a block view illustrating a treadmill system according to another exemplary embodiment of the present invention.

Referring to FIG. 7, the treadmill system 1000 according to another exemplary embodiment of the present invention includes a plurality of treadmill devices 100, a plurality of image photographing and controlling units 200 and a management server 300. Here, the plurality of treadmill devices 100 are configured to detect the looks of a user who is walking on a walking belt and automatically adjust an operating rate of walking belt, and the plurality of image photographing and controlling units 200 are configured to take pictures of the user's looks.

Each of the plurality of treadmill devices 100 controls a displaying operation to allow a user to select one of a plurality of already stored exercise course backgrounds, display the selected exercise course background as a virtual 3D object moving image, and project the virtual 3D object moving image at a reproduction rate corresponding to the operating rate of the treadmill device.

Each of the plurality of image photographing and controlling units 200 detects the user's looks in real time, takes pictures of the detected user's looks, generates user image data from the taken pictures of the user's looks, extracts and filters only the noise image data from the user image data, and extracts only the pure user image data remaining after the filtering operation.

The plurality of treadmill devices 100 receive the pure user image data from the local area network connected with the plurality of image photographing and controlling units 200, insert the received pure user image data onto the virtual 3D object moving image, finally generate a 3D user image in which the plurality of user's behavior patterns, which appear on the basis of the pure user image data, are engaged with the virtual 3D object moving image, and project the finally generated 3D user image.

Also, the management server 300 receives the pure user image data from the plurality of image photographing and controlling units 200 through the wired and wireless communication networks connected respectively with the plurality of treadmill devices 100 and the plurality of image photographing and controlling units 200, respectively, and receives click information on the exercise course backgrounds selected on the plurality of treadmill devices 100 by different users.

As the management server 300 confirms in real time whether to share information implemented between at least a plurality of treadmill devices 100 among the plurality of treadmill devices 100, the management server 300 sorts a plurality of different pure user image data received respectively from at least the plurality of treadmill devices 100 sharing the information, and transmits at least one different pure user image data, except for the pure user image data of the treadmill devices 100 themselves, to at least one treadmill device 100 whose information sharing is completed.

The management server 300 confirms click information on the exercise course backgrounds which are most frequently selected from the click information on the selected exercise course backgrounds assigned respectively by at least the plurality of treadmill devices 100 sharing the information, and transmits the click information on the exercise course backgrounds to at least the plurality of treadmill devices 100 sharing the information.

As a result, at least the plurality of treadmill devices 100 sharing the information receives the click information on the most frequently selected exercise course backgrounds from the management server 300 connected with the wired and wireless communication network, and also receives at least one differently generated pure user image data from at least one treadmill device 100 whose information sharing is completed.

At least the plurality of treadmill devices 100 sharing the information insert at least one different pure user image data as well as their own pure user image data onto the virtual 3D object moving image which is projected through the operating of the most frequently selected exercise course backgrounds, and finally generate 3D user images in which the user's behavior patterns, which appear on the basis of at least the one different pure user image data as well as their own pure user image data, are realized in the virtual 3D object moving image. Then, the finally generated 3D user images are seen with naked eye on the external devices provided outside the treadmill devices 100.

As described above, the treadmill device and the operating method of the same according to the present invention have the first effect in that the treadmill device and the operating method of the same is configured to detect a user who is taking exercise in real time, take pictures of the detected user's looks, and insert user image data as the results of data analysis, which are obtained from the taken pictures, into a virtual 3D object moving image which indicates the selected exercise course background, so as to project a 3D user image in which the user's behavior patterns are engaged with a virtual 3D object moving image. Therefore, since the treadmill device is used to allow a user to see his own looks taking exercise in real time, it is possible to prevent the user from feeling boring during exercise, and it is easy to continuously check the user's own physical status or conditions.

Also, the present invention has the second effect in that, since a user may actively employ exercise course backgrounds which are freely changed during exercise by the user's choices, the best information on the physical rhythm and exercise conditions may be offered to the user, thereby improving the user's satisfaction and buying power, which leads to an expected increase in the sales.

The present invention has been described in detail. However, it should be understood that the detailed description and specific examples, while indicating preferred embodiments of the invention, are given by way of illustration only, since various changes and modifications within the scope of the present invention will become apparent to those skilled in the art from this detailed description.

What is claimed is:

1. An apparatus comprising a treadmill device performing a running action and an image photographing and controlling unit connected with the treadmill device through a local area network and taking images of exercising user with the treadmill device, wherein the image photographing and controlling unit is configured to detect the user's looks in real time, take images of the detected user's looks to generate user image data, filter noise image data from the user image data, and extract the pure user image data remaining after the filtering operation, and wherein the treadmill device is configured to receive selection among a plurality of pre-stored exercise course backgrounds from a user, convert selected exercise course background into a virtual 3D object moving image having a reproduction rate corresponding to an operating rate of the treadmill device, generate a 3D user image by inserting the pure user image data into the virtual 3D object moving image, and display the 3D user image.

2. An apparatus comprising a treadmill device performing a running action and an image photographing and controlling unit connected with the treadmill device through a local area network and taking images of exercising user with the treadmill device, wherein the treadmill device is configured to receive selection among a plurality of pre-stored exercise course backgrounds from a user, and convert selected exercise course background into a virtual 3D object moving image having a reproduction rate corresponding to an operating rate of the treadmill device, and wherein the image photographing and controlling unit is configured to detect the user's looks in real time, take images of the detected user's looks to generate user image data, filter noise image data from the user image data, extract the pure user image data remaining after the filtering operation, generate a 3D user image by inserting the pure user image data into the virtual 3D object moving image, and display the 3D user image.

3. The treadmill system according to claim 2, wherein the image photographing and controlling unit further comprises a projector for displaying the 3D user image on a screen.

4. The treadmill system according to claim 2, wherein the treadmill device and the image photographing and controlling unit are present in plural and are connected with each other through a local area network, and wherein the 3D user image is generated by further inserting pure user image data of another user into the virtual 3D object moving image.

5. The treadmill system according to claim 1, wherein the treadmill device and the image photographing and controlling unit are present in plural and are connected with each other through a local area network, and wherein the 3D user image is generated by further inserting pure user image data of another user into the virtual 3D object moving image.

6. A method of operating a treadmill system comprising a treadmill device performing a running action and an image photographing and controlling unit connected with the treadmill device through a local area network and taking images of exercising user with the treadmill device, the method comprising:

converting an exercise course background, which is selected from a plurality of pre-stored exercise course backgrounds by a user, into a virtual 3D object moving image having a reproduction rate corresponding to an operating rate of the treadmill device;

detecting the user's looks in real time and taking images of the detected user's looks to generate user image data at the image photographing and controlling unit;

filtering noise image data from the user image data and extracting pure user image data remaining after the filtering operation at the image photographing and controlling unit;

generating a 3D user image at the treadmill device by inserting the pure user image data into the virtual 3D object moving image; and displaying the 3D user image at the treadmill device.

7. A method of operating a treadmill system comprising a treadmill device performing a running action and an image photographing and controlling unit connected with the treadmill device through a local area network and taking images of exercising user with the treadmill device, the method comprising:

converting an exercise course background, which is selected from a plurality of pre-stored exercise course backgrounds by a user, into a virtual 3D object moving image having a reproduction rate corresponding to an operating rate of the treadmill device;

detecting the user's looks in real time and taking images of the detected user's looks to generate user image data at the image photographing and controlling unit;

filtering noise image data from the user image data and extracting pure user image data remaining after the filtering operation at the image photographing and controlling unit;

generating a 3D user image at the image photographing and controlling unit by inserting the pure user image data into the virtual 3D object moving image; and displaying the 3D user image at the image photographing and controlling unit.

8. The method according to claim 7, wherein the displaying operation comprises displaying the 3D user image on the screen using a projector.

9. The method according to claim 7, wherein the treadmill device and the image photographing and controlling unit are present in plural and are connected with each other through a local area network, and wherein the operation of generating a 3D user image further comprises inserting pure user image data of another user into the virtual 3D object moving image.

10. The method according to claim 6, wherein the treadmill device and the image photographing and controlling unit are present in plural and are connected with each other through a local area network, and wherein the operation of generating a 3D user image further comprises inserting pure user image data of another user into the virtual 3D object moving image.

* * * * *